US008602725B2

(12) United States Patent
Itou et al.

(10) Patent No.: US 8,602,725 B2
(45) Date of Patent: Dec. 10, 2013

(54) CEILING FAN

(75) Inventors: Shigeo Itou, Osaka (JP); Tetsuji Kawazu, Osaka (JP)

(73) Assignee: Panasonic Corporation, Osaka (JP)

( * ) Notice: Subject to any disclaimer, the term of this patent is extended or adjusted under 35 U.S.C. 154(b) by 740 days.

(21) Appl. No.: 12/933,108

(22) PCT Filed: Apr. 13, 2009

(86) PCT No.: PCT/JP2009/001688

§ 371 (c)(1),
(2), (4) Date: Sep. 17, 2010

(87) PCT Pub. No.: WO2009/128240

PCT Pub. Date: Oct. 22, 2009

(65) Prior Publication Data

US 2011/0020135 A1 Jan. 27, 2011

(30) Foreign Application Priority Data

Apr. 15, 2008 (JP) ..... 2008-105444

(51) Int. Cl.
*F04D 29/44* (2006.01)

(52) U.S. Cl.
USPC ..... 415/150; 415/209.3; 415/211.2

(58) Field of Classification Search
USPC ..... 415/150, 209.3, 211.2
See application file for complete search history.

(56) References Cited

FOREIGN PATENT DOCUMENTS

| | | |
|---|---|---|
| CN | 85204850 | 1/1987 |
| JP | 50-53242 | 5/1975 |
| JP | 50-136011 | 11/1975 |
| JP | 52-36649 | 3/1977 |
| JP | 62-142898 | 6/1987 |
| JP | 02-102199 U | 8/1990 |
| JP | 4-62399 | 5/1992 |
| JP | 07-013679 Y | 4/1995 |
| JP | 2001-304193 | 10/2001 |
| JP | 2007-198337 | 8/2007 |

OTHER PUBLICATIONS

International Search Report of PCT Application No. PCT/JP2009/001688, dated May 12, 2009.

*Primary Examiner* — Edward Look
*Assistant Examiner* — Aaron R Eastman
(74) *Attorney, Agent, or Firm* — Panasonic Patent Center

(57) ABSTRACT

A configuration including outer-rotation motor portion (4) including stator (2) with a center through which fixed axis (1) passes, and rotor (3) pivotally supported capable of rotating around stator (2); a plurality of blade plates (5) radially arranged on rotor (3); support base (6) having fixed axis (1) in a center thereof and located in a lower part of stator (2); angle changing unit (7) provided on support base (6); and a plurality of stationary blade plates (9) being detachably placed on stationary blade holders provided on angle changing unit (7). With the configuration in which an elevation/depression angle of stationary blade plates (9) is adjustable by at least one stationary blade driving motor (10) that drives angle changing unit (7), a structure is simplified.

10 Claims, 13 Drawing Sheets

CEILING FAN

TECHNICAL FIELD

The present invention relates to a ceiling fan suspended from a ceiling, and used for reducing the sensible temperature by direct supply of air and for circulating air in a room.

BACKGROUND ART

Conventionally, as a ceiling fan of this kind, a ceiling fan has been known in which stationary blades whose elevation/depression angle for changing the wind direction is rotatable are disposed at the downstream side of rotating blade plates radially arranged on the outer periphery of an electric motor (see, for example, Patent Document 1).

Hereinafter, the ceiling fan is described with reference to FIGS. 17A, 17B, 18A, and 18B. FIG. 17A is an external perspective view showing a conventional ceiling fan, and FIG. 17B is an external top view showing the ceiling fan. FIG. 18A is an external side view showing a principal part of the ceiling fan, and FIG. 18B is an external side view showing an air flow of the ceiling fan.

As shown in FIGS. 17A to 18B, a plurality of blade plates 107 are radially disposed on rotor 105 incorporating electric motor 104 (see FIG. 18B). A plurality of plate-shaped stationary blades 110 fixed to non-rotating portion 106 are disposed in a lower part of blade plates 107. With such a configuration, as shown in FIGS. 18A and 18B, since a pressure is increased by collecting the kinetic energy of circumferential direction component 114 of blown air 113 flown out of blade plate 107, the air blowing efficiency can be improved. Furthermore, by changing the rate of circumferential direction component 114 and downward component 118 of blown air 113, the arrival range of blown air can be changed.

In this way, in a conventional ceiling fan, in order to adjust an air current from moving blades such as blade plates 107, a plurality of stationary blades 110 may be provided at the downstream side of the moving blades. In such a case, when elevation/depression angle θs of each stationary blade is changed, a plurality of driving motors are required. Alternatively, when one driving motor is used, a plurality of gears for converting and transmitting a rotation torque of one driving motor are required. Therefore, in any case, a number of components to be used for transmission is increased, thus complicating the structure. Furthermore, when repeated load of blown air is applied from the moving blade to stationary blade 110 for a long time, a fatigue failure occurs in the vicinity of the root of stationary blade 110, and the stationary blade may be broken. Thus, when the stationary blade is broken, stationary blade 110 may drop off.

[Patent Document 1] Japanese Patent Application Unexamined Publication No. 2007-198337

SUMMARY OF THE INVENTION

The present invention provides a ceiling fan having a configuration in which stationary blades whose elevation/depression angle is changeable are disposed at the downstream side of moving blades, and the number of components for transmitting a driving torque is reduced as possible so as to simplify a structure.

The present invention has a configuration which includes: an outer-rotation motor portion including a disk-like stator with a center through which a fixed axis passes, and an annular-shaped rotor pivotally supported capable of rotating around the stator; a plurality of blade plates radially arranged on the rotor; a support base having the fixed axis in a center of thereof and located in a lower part of the stator; an annular-shaped angle changing unit provided on the support base; and a plurality of stationary blade plates being detachably placed on stationary blade holders provided on the angle changing unit. An elevation/depression angle of the stationary blade plates is adjustable by at least one stationary blade driving motor that drives the angle changing unit.

According to such a configuration, stationary blades whose elevation/depression angle is changeable are disposed at the downstream side of moving blades, and the number of components for transmitting a driving torque can be reduced as possible so as to simplify a structure.

REFERENCE MARKS IN THE DRAWINGS

Figure 1:
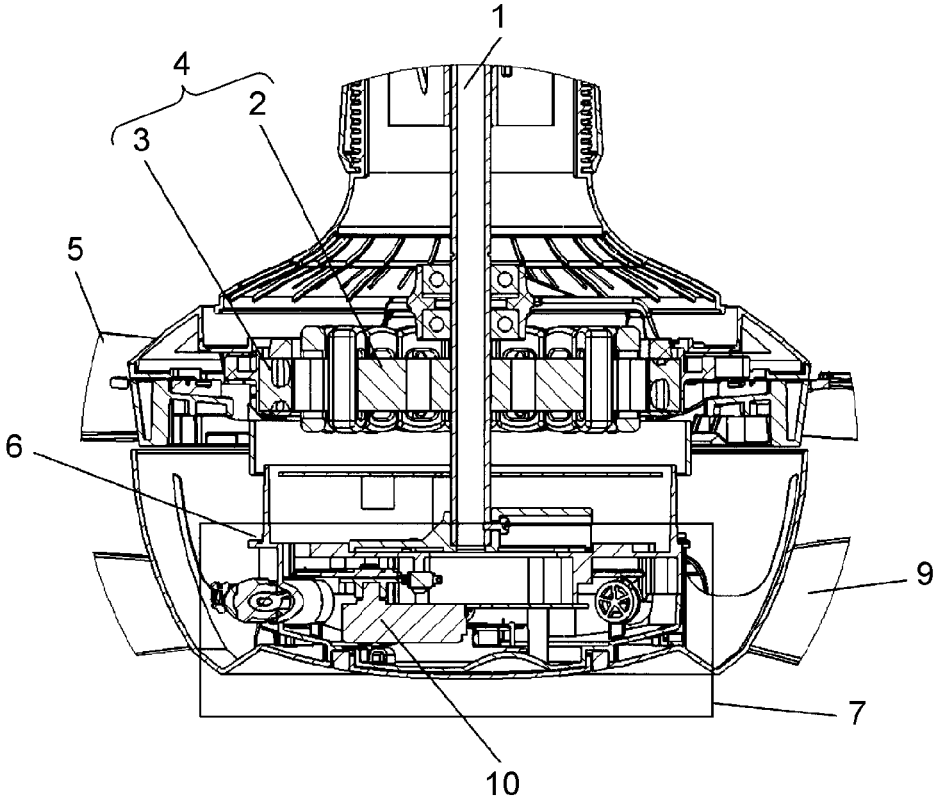
FIG. 1 is a sectional view showing a principal part of a ceiling fan in accordance with a first exemplary embodiment of the present invention.

1 fixed axis
2 stator
3 rotor
4 outer-rotation motor portion
5 blade plate
6 support base
6*a* holding portion
7 angle changing unit
8 stationary blade holder
8*a* engaging hole
8*b* stationary blade protruding portion
8*c* holding fitting portion
9 stationary blade plate
9*a* fitting portion
9*b* thin-wall portion
9*c* fitting hole
9*d* thin-plate protruding portion
10 stationary blade driving motor
10*a* rotation axis
11 eccentric cam
12 round cam
12*a* long hole portion
13 linkage
13*a* protruding portion
13*b* spherical portion
13*c* necking portion
14 movable plate portion
14*a* engaging protrusion
14*b* front end part
14*c* guide bar
15 pressing spring
15*a* tip folding portion
15*b* ring portion
15*c* rear end folding portion

DETAILED DESCRIPTION OF THE PREFERRED EMBODIMENT

Hereinafter, exemplary embodiments of the present invention are described with reference to drawings. However, the present invention is not intended to be limited to these exemplary embodiments.

First Exemplary Embodiment

Figure 2:
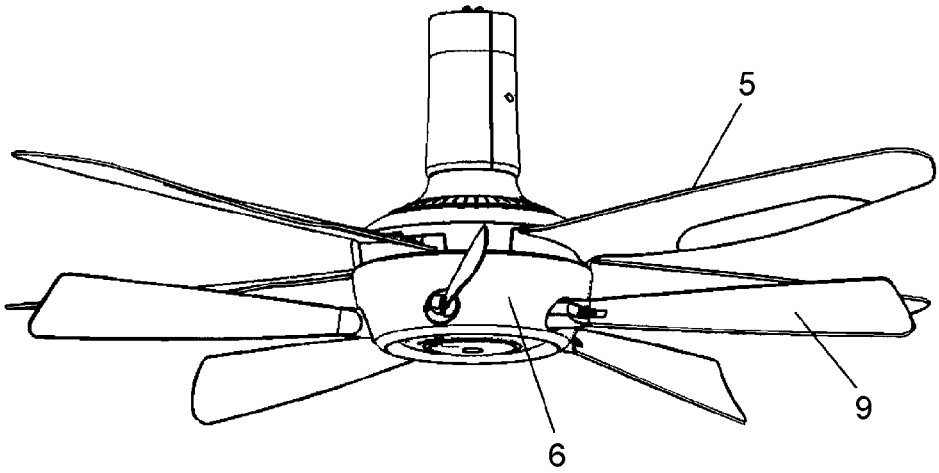
FIG. 2 is an external perspective view showing the ceiling fan.
Figure 3:
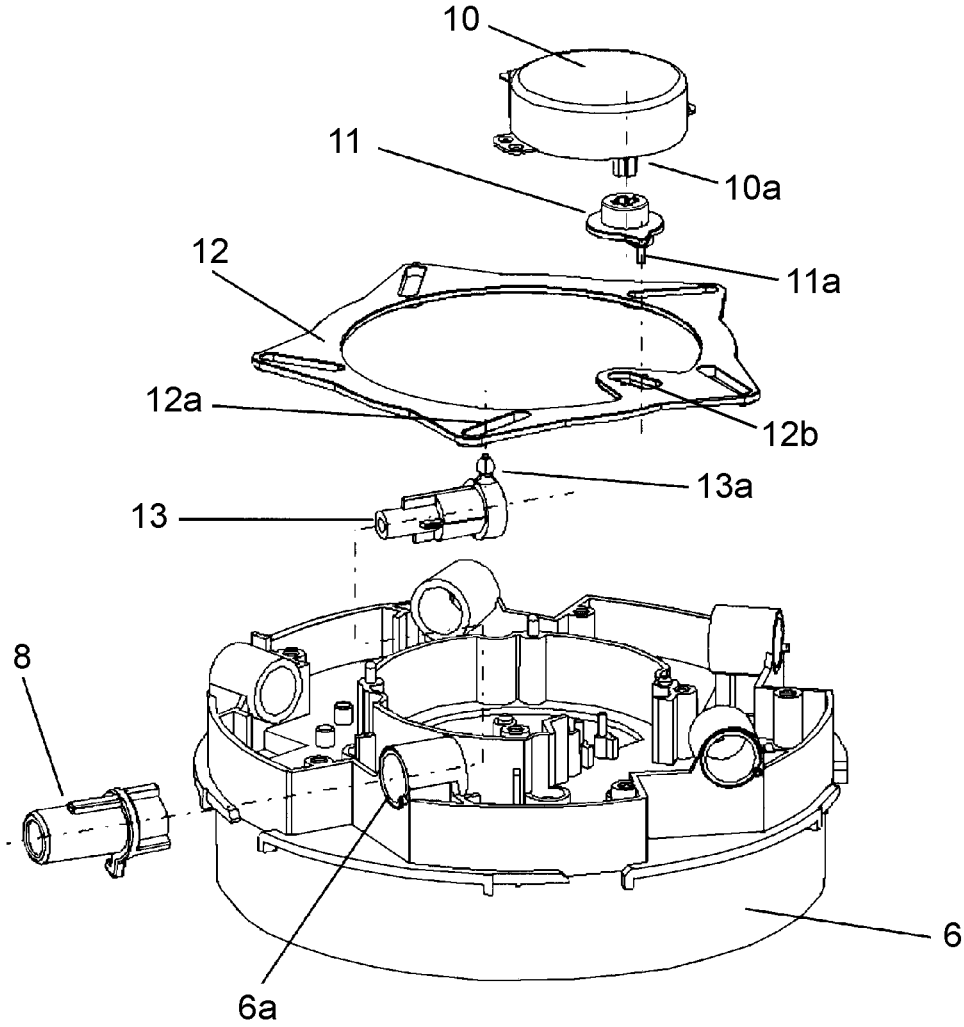
FIG. 3 is an exploded perspective view showing an angle changing unit of the ceiling fan in a state in which a back surface faces upward.
Figure 4:
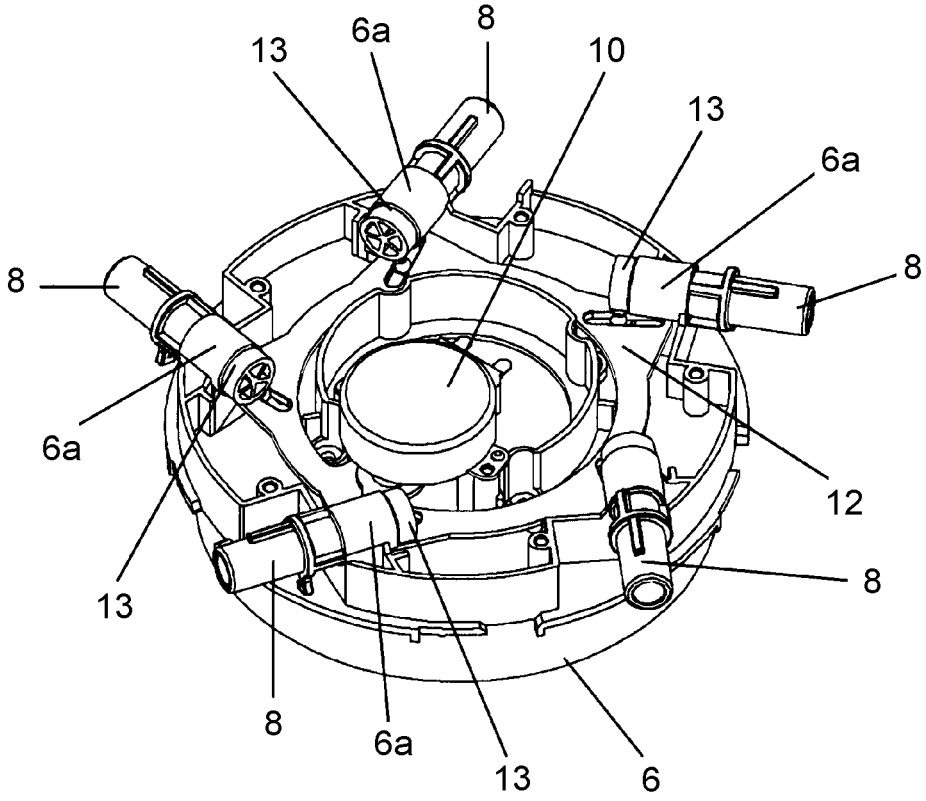
FIG. 4 is an external perspective view showing an angle changing unit of the ceiling fan in a state in which a back surface faces upward.
Figure 5A:
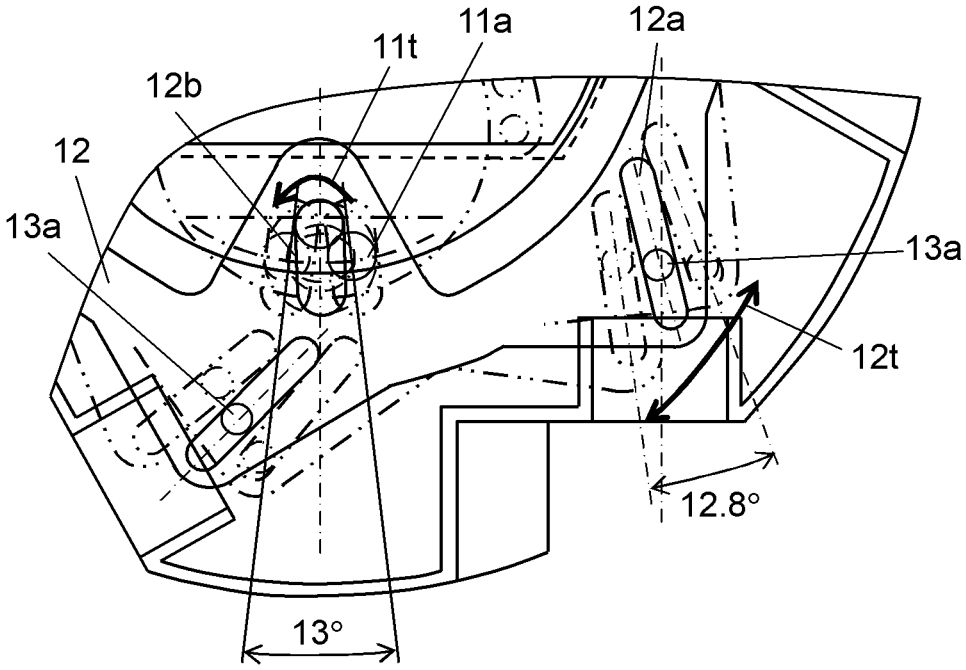
FIG. 5A is an enlarged view of a principal part showing an operation of a round cam of the angle changing unit of the ceiling fan.
Figure 5B:
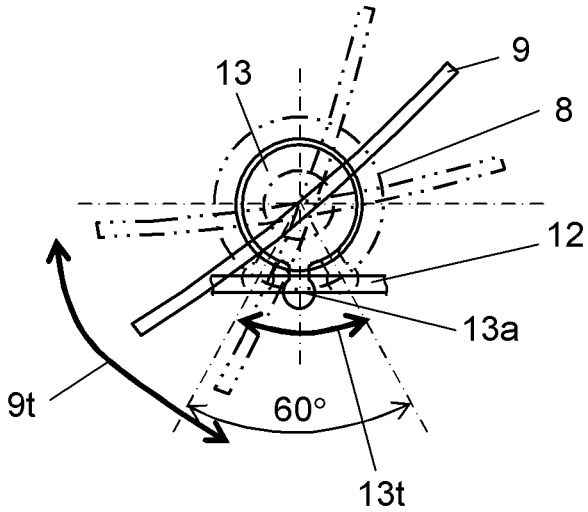
FIG. 5B is an enlarged view of a principal part showing an operation of a linkage and a stationary blade plate of the angle changing unit of the ceiling fan.
Figure 6:
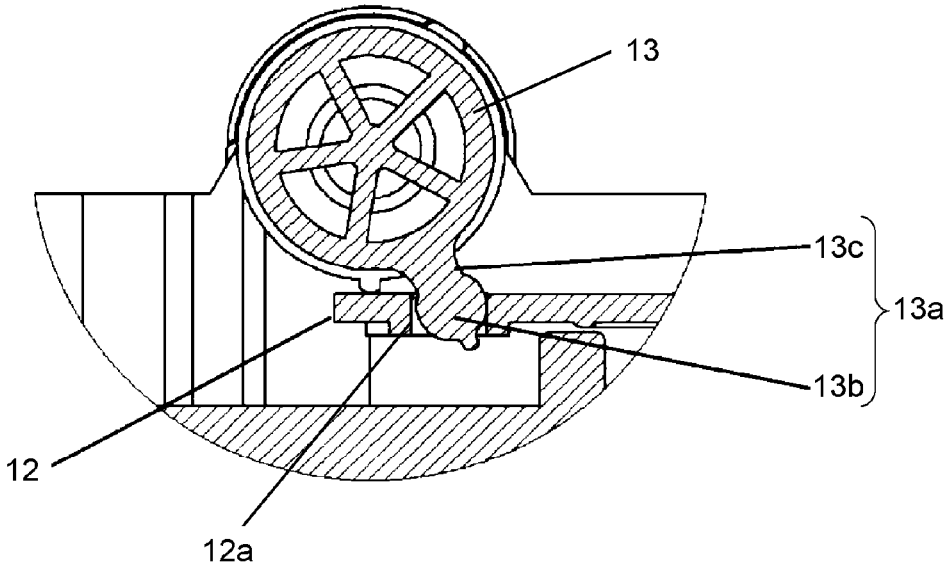
FIG. 6 is a schematic sectional view showing the linkage of the ceiling fan.
Figure 7:
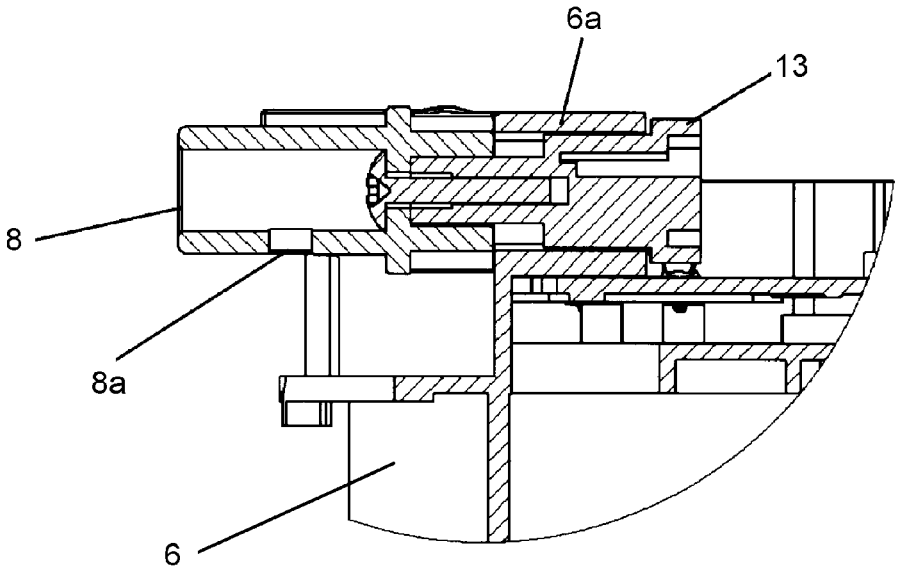
FIG. 7 is a sectional view of a principal part showing a relation between the linkage and a stationary blade holder of the ceiling fan.
Figure 8:
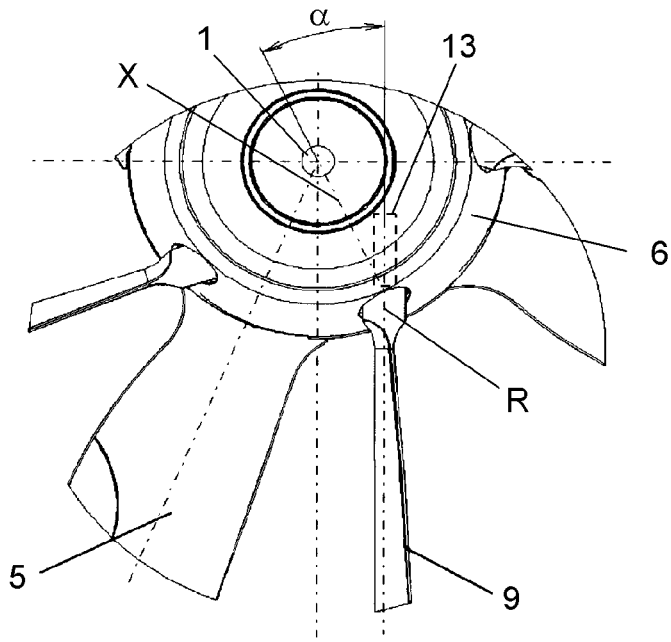
FIG. 8 is a view illustrating a relation between the stationary blade plate and a blade plate of the ceiling fan.

FIG. 1 is a sectional view showing a principal part of a ceiling fan in accordance with a first exemplary embodiment of the present invention. FIG. 2 is an external perspective view showing the ceiling fan. FIG. 3 is an exploded perspective view showing an angle changing unit of the ceiling fan when a back surface faces upward. FIG. 4 is an external perspective view showing an angle changing unit of the ceiling fan when a back surface faces upward. FIG. 5A is an enlarged view of a principal part showing an operation of a round cam of the angle changing unit of the ceiling fan. FIG. 5B is an enlarged view of a principal part showing an operation of a linkage and a stationary blade plate of the angle changing unit of the ceiling fan. FIG. 6 is a schematic sectional view showing the linkage of the ceiling fan. FIG. 7 is a sectional view of a principal part showing a relation between the linkage and a stationary blade holder of the ceiling fan. FIG. 8 is a view illustrating a relation between the stationary blade plate and a blade plate of the ceiling fan.

As shown in FIGS. 1 to 8, outer-rotation motor portion 4 includes disk-like stator 2 with a center through which fixed axis 1 passes, and annular-shaped rotor 3 pivotally supported capable of rotating around stator 2. A plurality of blade plates 5 are radially arranged on rotor 3. A support base 6 is detachably fixed around fixed axis 1 in a lower part of stator 2. An annular-shaped angle changing unit 7 is attached to the support base 6. Stationary blade holders 8 capable of elevation/depression rotation are provided to the angle changing unit 7. Stationary blade plates 9 are detachably placed in the stationary blade holders 8. An elevation/depression angle of stationary blade plate 9 can be adjusted via stationary blade holder 8 by one stationary blade driving motor 10 that drives angle changing unit 7.

That is to say, angle changing unit 7 includes eccentric cam 11 pivotally supported by rotation axis 10*a* of stationary blade driving motor 10 (see FIG. 3), and annular-shaped round cam 12 rotatably coupled around fixed axis 1 by eccentric cam 11. Furthermore, angle changing unit 7 includes a plurality of linkages 13 coupled to round cam 12 such that they operate together and pivotally supported rotatably around the horizontal axis, and stationary blade holders 8 that are rotatably provided to be integrated with linkage 13.

Furthermore, protruding portion 13*a* provided on the outer peripheral surface of linkage 13 is slidably inserted into long hole portion 12*a* provided in round cam 12. As shown in FIG. 6, protruding portion 13*a* includes spherical portion 13*b* on the tip and necking portion 13*c* on the foot of spherical portion 13*b*.

Furthermore, linkage 13 is formed in a lateral cylindrical shape. Holding portion 6*a* provided to be integrated with support base 6 is formed in a lateral hollow cylindrical shape. Linkage 13 is inserted into holding portion 6*a*, and thereby the cylindrical-shaped outer periphery of linkage 13 is rotatably held by hollow cylindrical-shaped holding portion 6*a*.

Furthermore, as shown in FIG. 8, each rotation axis R of each linkage 13 is provided in the direction at same angle $\alpha$ from each standard line X linking between the center of fixed axis 1 of outer-rotation motor portion 4 and the tip of each linkage 13.

Note here that angle changing unit 7 to which stationary blade driving motor 10 is annexed is attached to support base 6. Support base 6 is detachably provided in the lower part of stator 2, independently.

According to the above-mentioned configuration, support base 6 is provided around fixed axis 1 and located in the lower part of stator 2, and the vertical axis of one stationary blade driving motor 10 placed on support base 6 is coupled to angle changing unit 7. Thus, stationary blade holders 8 provided on angle changing unit 7 are rotated around the horizontal axis, so that a plurality of stationary blade plates 9 detachably placed to stationary blade holders 8 can be held in such a manner in which the angles are changed to the same angle at one time. Thus, it is possible to adjust the air-blowing speed and the air-blowing range with a simple structure without using a plurality of gears and with the small number of components.

By changing the elevation/depression angle of the stationary blade in this way, it is possible to change the air-blowing range and the air-blowing speed according to places on which a ceiling fan is set and conditions of use. Firstly, by increasing the elevation/depression angle of the stationary blade, a circulation direction component of the blown air is changed to a downward direction component so as to narrow the arrival range of blown air. Thus, the arrival range of blown air is reduced and at the same time the downward air-blowing speed can be increased. Furthermore, by reducing the angle of the stationary blade, the arrival range of the blown air is widened so as to increase the circling direction component. Thus, air current with low air-blowing speed can be spread through the room.

As shown in FIG. 3, eccentric cam 11 has axis portion 11*a* extending to round cam 12 side, and axis portion 11*a* is movably inserted and engaged with short hole portion 12*b* of round cam 12. FIG. 5A is a view illustrating an operation of round cam 12 seen from the upper part. FIG. 5B is a view illustrating an operation of linkage 13 seen from the front part. As shown in FIG. 5A, an axial rotation operation of stationary blade driving motor 10 is converted into a movement in which round cam 12 moves in a reciprocating circular arc orbit via axis portion 11*a* of eccentric cam 11 concentrically with support base 6 on the horizontal plane at a predetermined angle 11*t* (the angle is set to 13° in this exemplary embodiment). Long hole portion 12*a* formed in round cam 12 moves in the range of angle 12*t* (the angle is set to 12.8° in this exemplary embodiment). Linkage 13 having protruding portion 13*a* slidably engaged with long hole portion 12*a* is held rotatably around a horizontal axis on the side surface of support base 6. Therefore, as shown in FIG. 5B, the movement of linkage 13 is converted into a reciprocating movement around the horizontal axis at a predetermined angle 13*t* (the angle is set to 60° in this exemplary embodiment) in a linked motion with the operation of round cam 12. Therefore, cylindrical-shaped stationary blade holder 8 fixed to linkage 13 is rotated around the horizontal axis, and is allowed to be variable in the range of elevation/depression angle 9*t* (the angle is set to 60° in this exemplary embodiment) of stationary blade plate 9.

Furthermore, long hole portion 12*a* of round cam 12 rotating concentrically with support base 6 can make a reciprocating movement while it moves in a circular orbit on the horizontal plane. Protruding portion 13*a* of linkage 13 rotating around the horizontal axis on the side surface of support base 6 is inserted into and engaged with long hole portion 12*a*. Therefore, the movement of long hole portion 12*a* on the horizontal plane can be converted into a movement of rotating around the horizontal axis of linkage 13 as a reference.

Herein, as mentioned above, protruding portion 13*a* of linkage 13 has a shape combining spherical portion 13*b* and necking portion 13*c*. Therefore, even when the distance between the horizontal axis around which linkage 13 rotates and long hole portion 12*a* of round cam 12 is slightly displaced, long hole portion 12*a* of round cam 12 and protruding portion 13*a* of linkage 13 are not complicated with each other and are not firmly engaged with each other. Therefore, linkage 13 can be driven smoothly. Note here that by applying a lubricant such as silicone grease, linkage 13 can be operated more smoothly.

Furthermore, as shown in FIG. 7, cylindrical-shaped stationary blade holder 8 to which stationary blade plate 9 is attached supports the weight of stationary blade plate 9 and the wind pressure load and the fluctuation load at the time when an angle is changed. However, since linkage 13 with which stationary blade holder 8 is integrated and fixed is held by a hollow cylindrical-shaped support base 6 on the outer peripheral part, and therefore linkage 13 is strongly pivotally supported rotatably around the horizontal axis at a predetermined angle. Therefore, the horizontal axis can be maintained horizontally by suppressing the sagging downward due to the weight of stationary blade plate 9 and the wind pressure load. At the same time, with respect to load fluctuation due to the rotation of stationary blade plate 9, the horizontal axis direction and the rotation angle can be maintained against the fluctuation of the wind pressure. Therefore, it is possible to surely exhibit the function of changing the wind direction by stationary blade plate 9.

Furthermore, a plurality of blade plates 5 are radially arranged at an equal angle around the vertical central axis of outer-rotation motor portion 4. However, rotation axis R of linkage 13 supporting stationary blade plate 9 is provided in a direction at same angle $\alpha$ from each standard line X linking between the center of fixed axis 1 of outer-rotation motor portion 4 and the tip of linkage 13. Thus, regardless of the rotation positions of blade plate 5, stationary blade plates 9 can be disposed so that they are not overlapped with portions located right under blade plates 5. Therefore, it is possible to suppress the rapid pressure change by the interference by stationary blade plate 9 that is adjacent to blade plate 5, and it is possible to achieve a quiet air-blowing operation with less occurrence of vibration or noise.

Furthermore, when angle changing unit 7 is added as an option to the lower part of the ceiling fan main body, it can be added and assembled even in a state in which the main body is attached to the ceiling. Furthermore, when it is exchanged with another option such as a light unit, a large-scale installation operation is not needed, and it can be carried out by a simple exchanging operation.

Second Exemplary Embodiment

Figure 9:
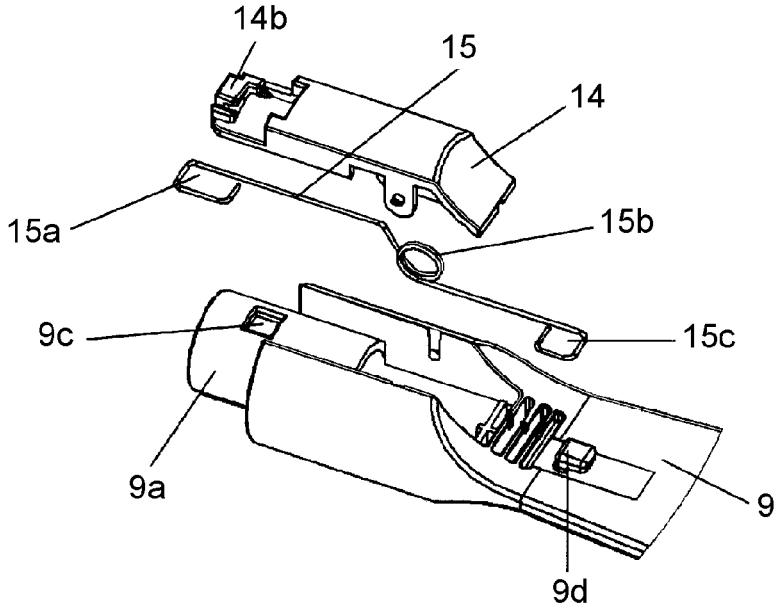
FIG. 9 is an exploded perspective view showing a relation between a stationary blade plate and a movable plate portion in accordance with a second exemplary embodiment of the present invention.
Figure 10:
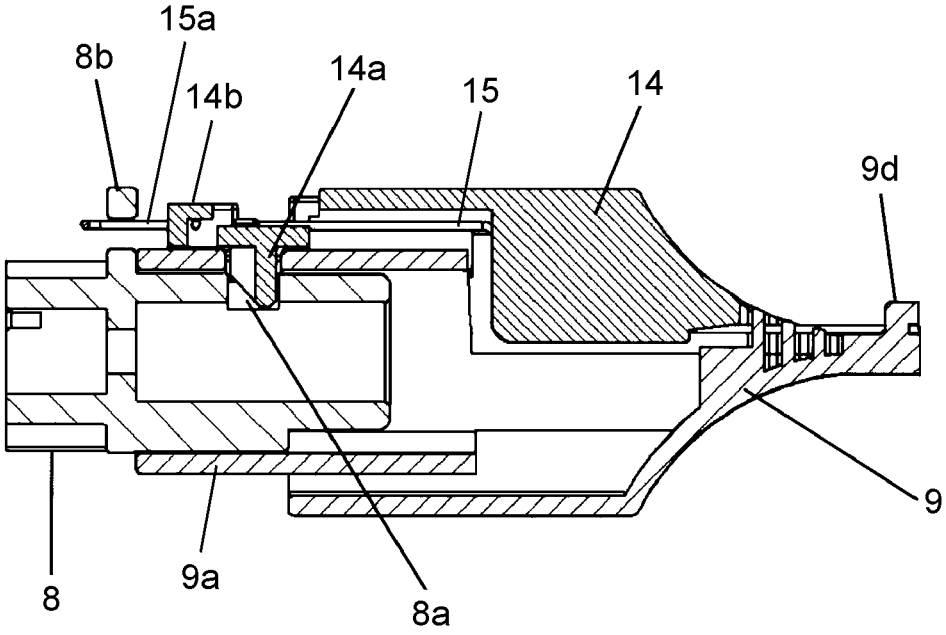
FIG. 10 is a sectional view of a principal part in assembly of a stationary blade holder and the stationary blade plate of the ceiling fan.
Figure 11A:
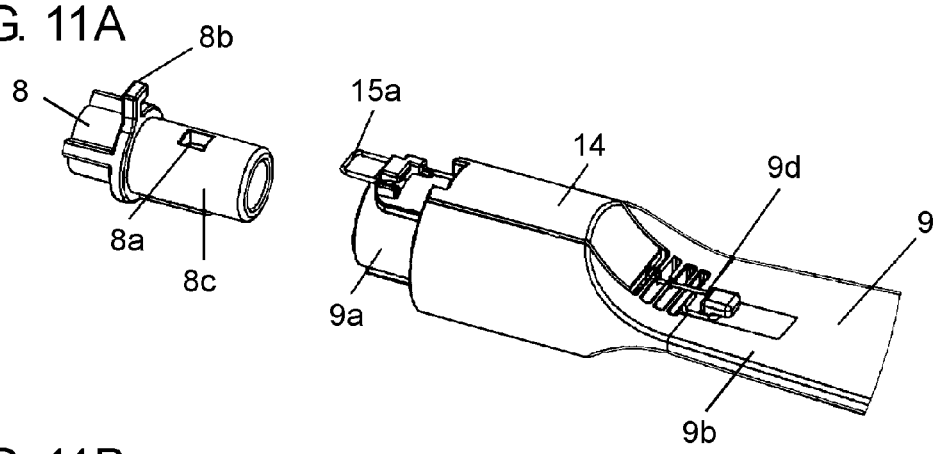
FIG. 11A is an external perspective view before assembly of the stationary blade holder and the stationary blade plate of the ceiling fan.
Figure 11B:
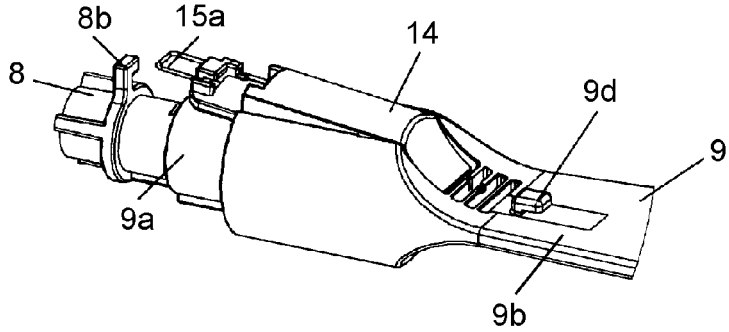
FIG. 11B is an external perspective view during assembly of the stationary blade holder and the stationary blade plate of the ceiling fan.
Figure 11C:
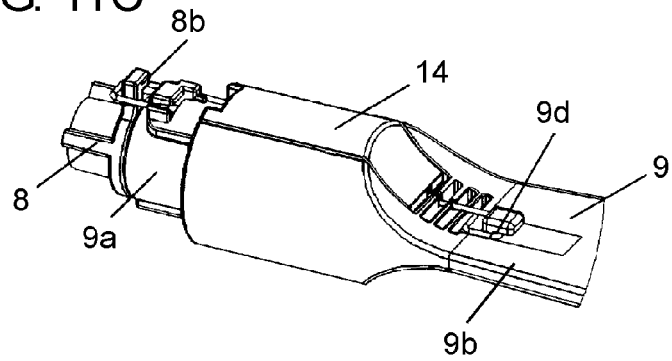
FIG. 11C is an external perspective view after assembly of the stationary blade holder and the stationary blade plate of the ceiling fan.
Figure 12:
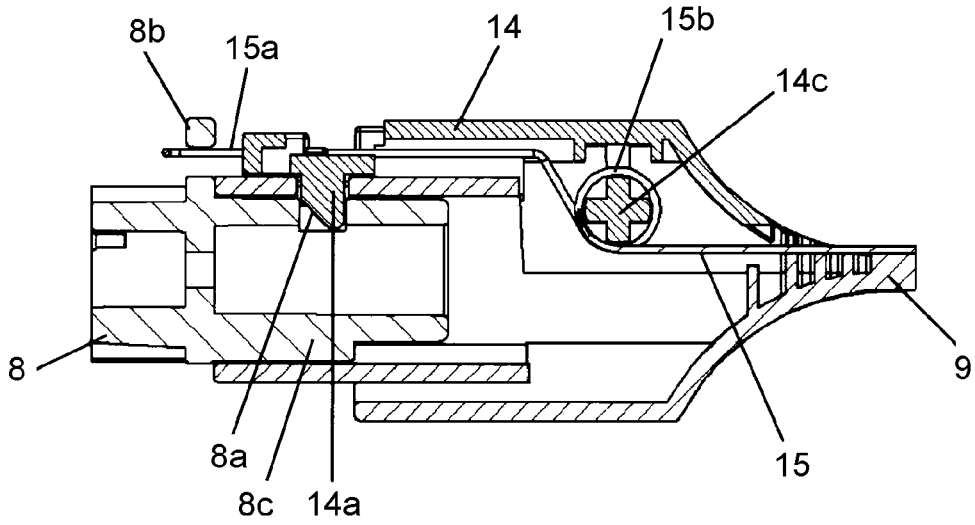
FIG. 12 is a sectional view of a principal part showing a state of a pressing spring when the stationary blade plate of the ceiling fan is assembled.
Figure 13:
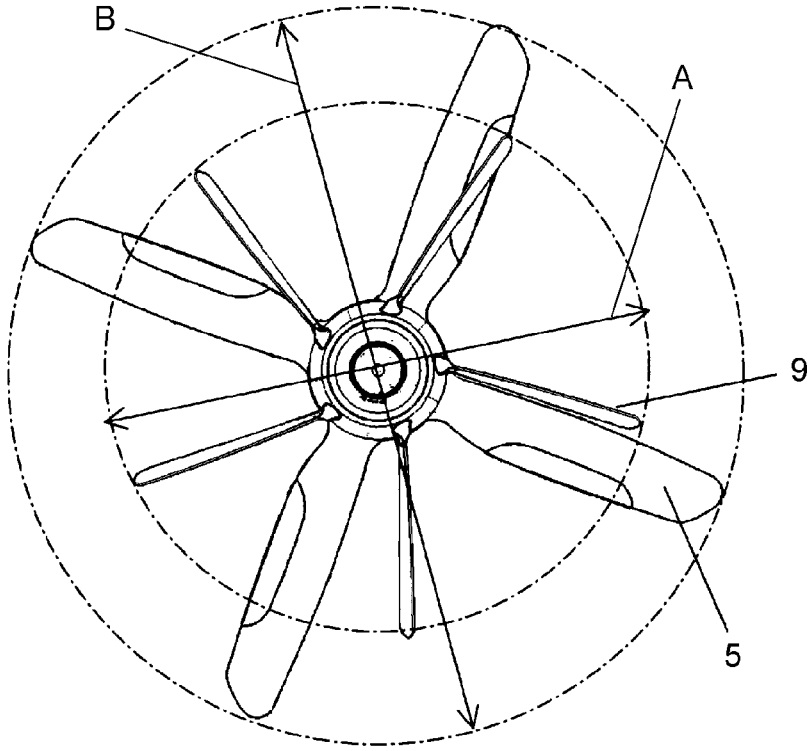
FIG. 13 is a bottom view showing a relation between the total length of the blade plate and the total length of the stationary blade plate of the ceiling fan.
Figure 14:
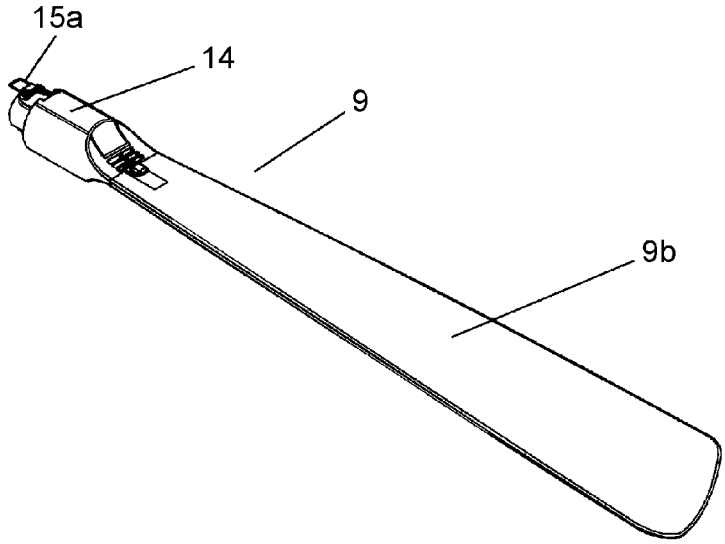
FIG. 14 is an external perspective view of the stationary blade plate of the ceiling fan.
Figure 15:
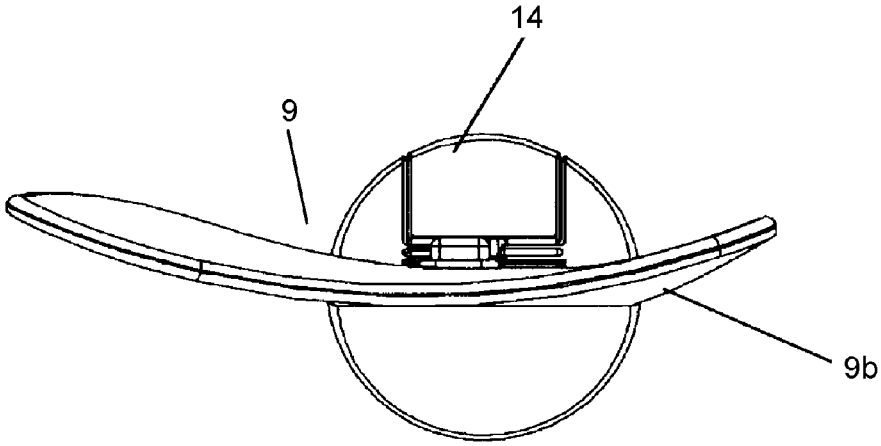
FIG. 15 is an external side view of the stationary blade plate of the ceiling fan.
Figure 16A:
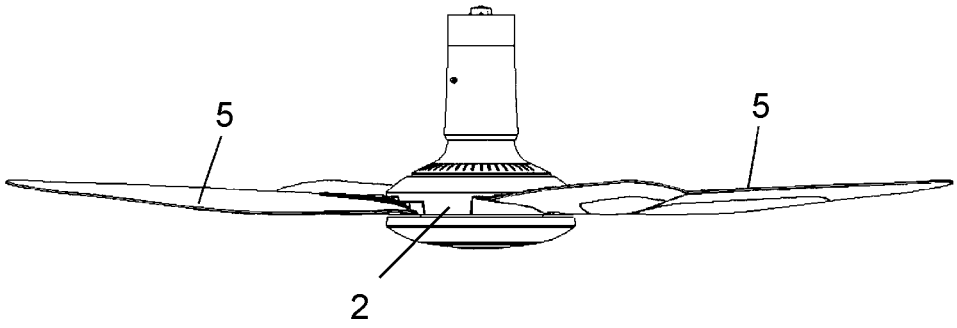
FIG. 16A is an external side view showing a ceiling fan without including a support base of the ceiling fan.
Figure 16B:
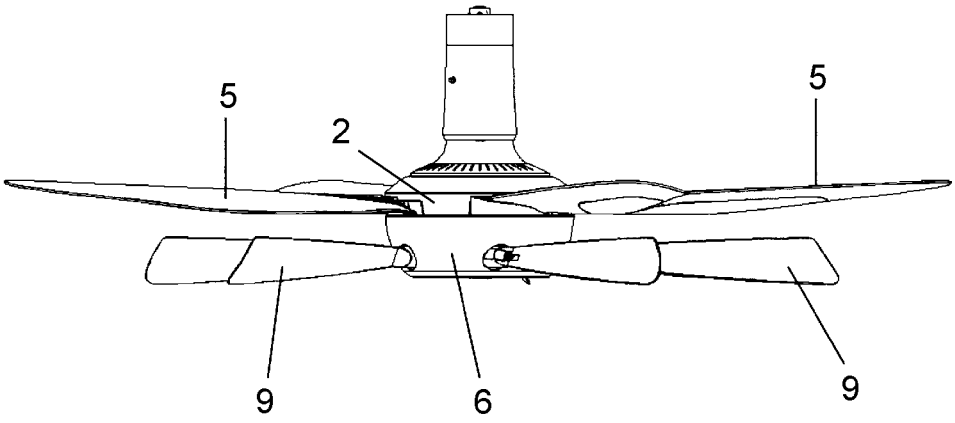
FIG. 16B is an external side view showing a ceiling fan including a support base and the stationary blade plates of the ceiling fan.
Figure 17A:
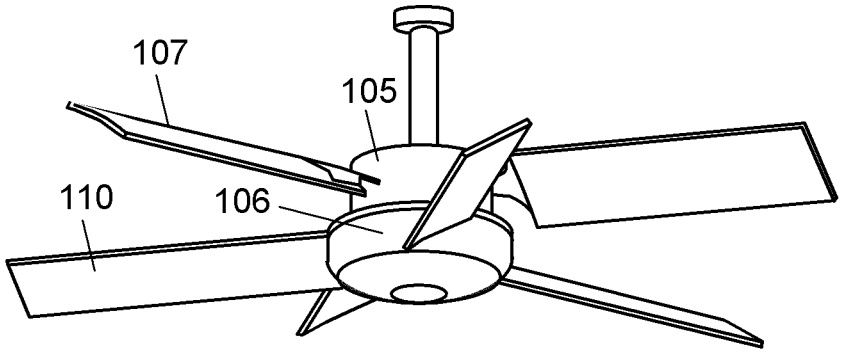
FIG. 17A is an external perspective view showing a conventional ceiling fan.
Figure 17B:
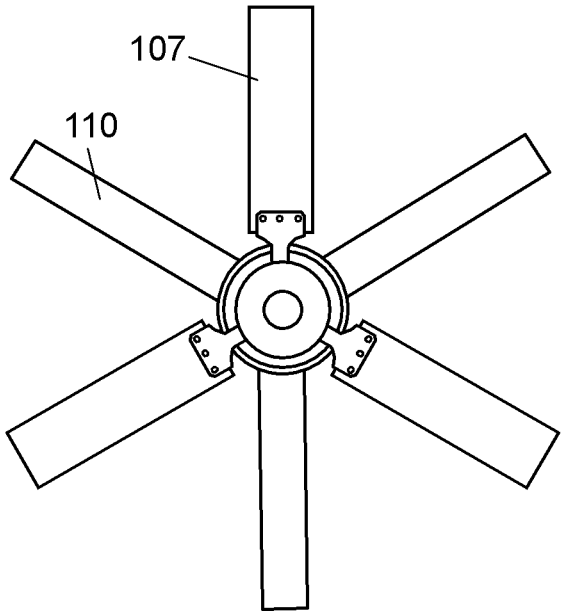
FIG. 17B is an external top view showing the ceiling fan.
Figure 18A:
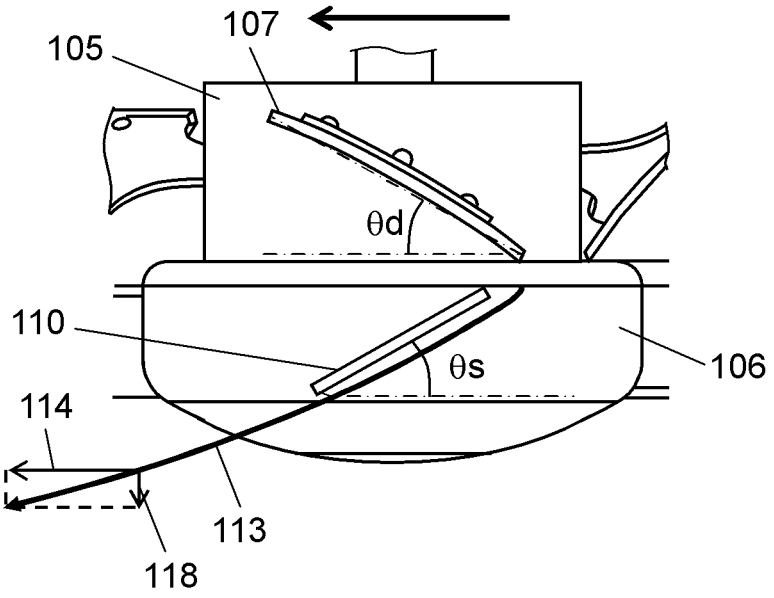
FIG. 18A is an external side view showing a principal part of the ceiling fan.
Figure 18B:
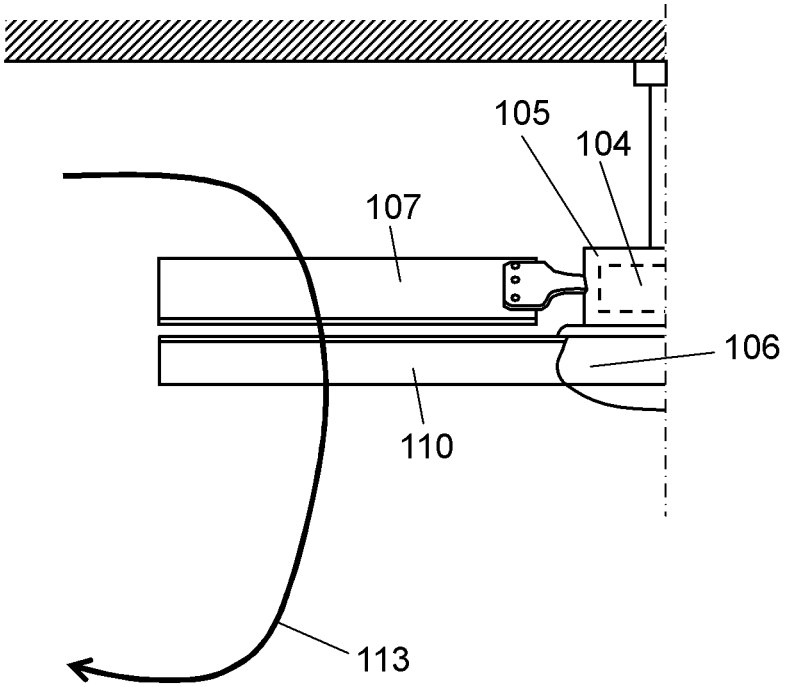
FIG. 18B is an external side view showing an air flow of the ceiling fan.

FIG. 9 is an exploded perspective view showing a relation between a stationary blade plate and a movable plate portion in accordance with a second exemplary embodiment of the present invention. FIG. 10 is a sectional view of a principal part in assembly of a stationary blade holder and the stationary blade plate of the ceiling fan. FIG. 11A is an external perspective view before assembly of the stationary blade holder and the stationary blade plate of the ceiling fan. FIG. 11B is an external perspective view during assembly of the stationary blade holder and the stationary blade plate of the ceiling fan. FIG. 11C is an external perspective view after assembly of the stationary blade holder and the stationary blade plate of the ceiling fan. FIG. 12 is a sectional view of a principal part showing a state of a pressing spring when the stationary blade plate of the ceiling fan is assembled. FIG. 13 is a bottom view showing a relation between the total length of the blade plate and the total length of the stationary blade plate of the ceiling fan. FIG. 14 is an external perspective view of the stationary blade plate of the ceiling fan. FIG. 15 is an external side view of the stationary blade plate of the ceiling fan. FIG. 16A is an external side view showing a ceiling fan without including a support base of the ceiling fan. FIG. 16B is an external side view showing a ceiling fan including a support base and the stationary blade plates of the ceiling fan. Note here that FIGS. 9 to 12, 14 and 15 are shown with upside down for the convenience of description.

As shown in FIGS. 9 to 16B, in this exemplary embodiment, fitting portion 9*a* to which stationary blade holder 8 is engageably and detachably placed is provided on the root portion of stationary blade plate 9. In the upper part of fitting portion 9*a* of stationary blade plate 9, movable plate portion 14 and pressing spring 15 are provided. Movable plate portion 14 is pivotally supported rotatably from the horizontal direction to the elevation angle direction; and pressing spring 15 biases movable plate portion 14 to fitting portion 9*a* side. Engaging protrusion 14*a* provided on the back surface of movable plate portion 14 is allowed to slide while it is biased to the outer peripheral surface of stationary blade holder 8 in a state in which it penetrates into fitting hole of fitting portion 9*a*, and then engaging protrusion 14*a* can be fitted into engaging hole portion 8*a* provided in stationary blade holder 8.

Furthermore, pressing spring 15 for pressing movable plate portion 14 pivotally supported rotatably on stationary blade plate 9 has tip folding portion 15*a* processed in a ring shape. When tip folding portion 15*a* is located on front end part 14*b* of movable plate portion 14, and stationary blade plate 9 is placed in stationary blade holder 8, tip folding portion 15*a* can be engaged with stationary blade protruding portion 8*b* provided on stationary blade holder 8.

Furthermore, the tip position of stationary blade plate 9 is provided concentrically with blade plate 5 such that it falls in between 60% to 90% of the total length of blade plate 5. The cross sectional shape of thin-wall portion 9*b* of stationary blade plate 9 is a circular arc shape that is convex downward. The thickness dimension of thin-wall portion 9*b* is reduced sequentially at the tip side of stationary blade plate 9.

Furthermore, as shown in FIG. 12, ring portion 15*b* of pressing spring 15 is fitted into guide bar 14*c* that is an axis of the rotation of movable plate portion 14. Along with this, fitting protrusion 14*a* of movable plate portion 14 is detachably placed on engaging hole portion 8*a* provided on holding fitting portion 8*c* of stationary blade holder 8. Tip folding portion 15*a* provided on the tip of pressing spring 15 is engageably provided on stationary blade protruding portion 8*b* of stationary blade holder 8, and rear end folding portion 15*c* provided on the rear end of pressing spring 15 is engaged with thin-plate protruding portion 9*d*.

With the above-mentioned configuration, holding fitting portion 8*c* of stationary blade holder 8 and fitting portion 9*a* of stationary blade plate 9 are detachably fitted to each other. Movable plate portion 14, which is pivotally supported rotatably only in the elevation angle direction, is provided in the upper part of fitting portion 9*a* of stationary blade plate 9. Engaging protrusion 14*a* provided on the back side of movable plate portion 14 is always pressed onto holding fitting portion 8*c* of stationary blade holder 8 by pressing spring 15 (FIG. 11A). Therefore, when a hollow cylindrical shape portion (fitting portion 9*a*) of stationary blade plate 9 is fitted into holding fitting portion 8*c* of stationary blade holder 8, engaging protrusion 14*a* of movable plate portion 14 advances while it is brought into contact with and pushed up by the surface of holding fitting portion 8*c* of stationary blade holder 8 (FIG. 11B). Thereafter, finally, engaging protrusion 14*a* is fitted into and placed in engaging hole portion 8*a* of stationary blade holder 8, so that the fitting force is maintained by pressing spring 15. Therefore, it is possible to confirm by the feel that stationary blade plate 9 is securely placed on a predetermined position and it is possible to maintain the placed stationary blade plate 9 and to prevent it from dropping off (FIG. 11C).

Furthermore, pressing spring 15 is set on movable plate portion 14 that is rotatably set on stationary blade plate 9. Rear end folding portion 15*c* that is provided on one end of pressing spring 15 is engaged with thin-plate protruding portion 9*d* provided on the thin plate portion of stationary blade plate 9 (FIG. 11A). Therefore, tip folding portion 15*a* provided on the other end of pressing spring 15 advances while engaging protrusion 14*a* of movable plate portion 14 is lifted up by holding fitting portion 8*c* of stationary blade holder 8 when stationary blade plate 9 is placed on stationary blade holder 8 (FIG. 11B). Furthermore, when engaging protrusion 14*a* of movable plate portion 14 is fitted into engaging hole portion 8*a*, tip folding portion 15*a* on the other end of pressing spring 15 fixed to movable plate portion 14 is also engaged with stationary blade protruding portion 8*b* of stationary blade holder 8 simultaneously. Therefore, thin plate portion 9*b* of stationary blade plate 9 and stationary blade protruding portion 8*b* of stationary blade holder 8 are coupled to each other by pressing spring 15 (FIG. 11C). Thus, when stationary blade plate 9 is broken, the thin plate portion can be prevented from dropping off.

Furthermore, as shown in FIG. 13, from the vicinity of the center part of blade plate 5 to the middle at the outer peripheral side of the ceiling fan, the blade efficiency is good. Specifically, in 60% to 90% of total diameter B of the moving blade, the air blowing efficiency is good, and especially, in around 75%, the best air blowing efficiency can be achieved. Therefore, total diameter A of the stationary blade is set so that stationary blade plate 9 falls in the range in which the air blowing efficiency of blade plate is good. Furthermore, as shown in FIG. 15, the cross-sectional shape of thin-wall portion 9*b* of stationary blade plate 9 is made to be a circular shape that is convex downward and receives a load of blown air of the blade plate. Thus, it is possible to efficiently change the direction of blowing air while the strength is kept so that stationary blade plate 9 does not bend. Furthermore, the thickness dimension of thin-wall portion 9*b* is reduced sequentially at the tip side of stationary blade plate 9, thereby reducing the gravity load to bending.

Furthermore, since guide bar 14*c* provided on movable plate portion 14 can function as an axis of rotation of movable plate portion 14 and a fulcrum of pressing spring 15, the configuration of movable plate portion 14 can be simplified and the number of components can be reduced. Along with this, when stationary blade plate 9 is placed to stationary blade holder 8, tip folding portion 15*a* of pressing spring 15 is fitted to stationary blade protruding portion 8*b* of stationary blade holder 8, and rear end folding portion 15*c* of pressing spring 15 is engaged with thin-plate protruding portion 9*d*. Therefore, when break occurs between the root portion of stationary blade plate 9 and the thin plate portion, or when movable plate portion 14 is broken and detached, stationary blade plate 9 is coupled to stationary blade holder 8 by pressing spring 15 and can be held without dropping off. Therefore, dropping of stationary blade plate 9 is prevented in advance and safety can be secured.

FIG. 16A shows a ceiling fan in a state in which angle changing unit 7 is removed. FIG. 16B shows a state in which support base 6 onto which angle changing unit 7 is placed is attached to the lower part of stator 2. Support base 6 and stator 2 can be connected to each other by using any engaging mechanism such as an engaging claw.

In this way, this exemplary embodiment has a configuration in which angle changing unit 7 is detachably provided independently in the lower part of stator 2. According to this configuration, when angle changing unit 7 is added as an option to the lower part of the ceiling fan main body, it can be added and assembled in a state in which the main body is set on the ceiling. Furthermore, when it is exchanged with another option such as a lighting unit, large scale installation work is not necessary. An exchange operation can be carried out by a simple operation.

Note here that in the above-mentioned exemplary embodiment, a case including one stationary blade driving motor is described. However, the stationary blade driving motor is not necessarily limited to one, and two or three stationary blade driving motors can be used. However, when one stationary blade driving motor is used, the effect of reducing the number of components becomes the maximum.

As described above, the present invention includes an outer-rotation motor portion composed of a disk-like stator with a center through which a fixed axis passes, and an annular-shaped rotor pivotally supported capable of rotating around the stator. Furthermore, the present invention includes a plurality of blade plates that are radially arranged on the rotor, and a support base provided around the fixed axis in the lower part of the stator. Furthermore, the present invention includes an annular-shaped angle changing unit provided on the support base, and a plurality of stationary blade plates that are detachably placed on a stationary blade holder provided on the angle changing unit. Furthermore, in the present invention, the elevation/depression angle of a stationary blade plate can be adjusted by one stationary blade driving motor for driving the angle changing unit.

According to this configuration, a support base is provided around the fixed axis in a lower part of the stator, and a vertical axis of one stationary blade driving motor placed on this support base can be coupled to the angle changing unit. Thus, a stationary blade holder provided on the angle changing unit is rotatably operated around the horizontal axis, and a plurality of stationary blade plates detachably placed on the stationary blade holder can be held by changing to the same angle at one time. Therefore, it is possible to adjust the air-blowing speed and the air-blowing range by a simple structure whose number of components is small. That is to say, by changing the elevation/depression angle of the stationary blade, it is possible to change the air-blowing range and the air-blowing speed according to places on which a ceiling fan is set and conditions of use. Firstly, by increasing the elevation/depression angle of the stationary blade, a circulation direction component of the blown air is changed to a downward direction component so as to narrow the arrival range of blown air. Thus, the arrival range of blown air is reduced and at the same time the downward air-blowing speed can be increased. Furthermore, by reducing the angle of the stationary blade, the arrival range of the blown air is widened so as to increase the circling direction component. Thus, air current with low air-blowing speed can be spread through the room.

Furthermore, in the present invention, an angle changing unit includes an eccentric cam pivotally supported by the rotation axis of the stationary blade driving motor, an annular-shaped round cam coupled rotatably around the fixed axis by the eccentric cam, a plurality of linkages coupled in a manner in which it operates together with the round cam and pivotally supported rotatably around the horizontal axis, and stationary blade holders rotatably provided to be integrated with the linkages.

According to this configuration, an axial rotation operation of the stationary blade driving motor is converted into a movement in which a round cam moves concentrically with the support base in a reciprocating circular orbit at a predetermined angle on the horizontal plane via an eccentric cam. Since a linkage having a protruding portion that is slidably engaged with a long hole portion disposed in the round cam is held on the side surface of the support base around the horizontal axis, the movement of the linkage is converted into a reciprocating movement at the certain angle around a horizontal axis together with the operation of the round cam. Therefore, a cylindrical-shaped stationary blade holder fixed to the linkage is rotated around the horizontal axis, and the elevation/depression angle of the stationary blade plate can be made to be variable.

Furthermore, in the present invention, a protruding portion provided on the outer peripheral surface of the linkage is slidably inserted into an engaging hole portion provided in the round cam. The protruding portion has a spherical portion on the tip, and a necking portion on the root portion of this spherical portion.

With such a configuration, the long hole portion of the round cam rotating concentrically with the support base makes a reciprocating movement while it moves in a circular orbit on the horizontal plane. On the side surface of the support base, a protruding portion of the linkage rotating around the horizontal axis moves in an orbit rotating around a horizontal axis as a reference on the vertical plane. The protruding portion of the linkage composed of a spherical portion and a necking portion coincides with the long hole portion in the round cam. Therefore, even if the distance between centers of the horizontal axis around which the linkage rotates and the round cam is slightly displaced, the long hole portion of the round cam and the protruding portion of the linkage are prevented from being firmly engaged with each other, and smooth driving can be carried out.

Furthermore, in the present invention, a linkage is formed in a lateral cylindrical shape and a holding portion provided to be integrated with the support base is formed in a hollow cylindrical shape that is rotatably held on the periphery of the linkage.

According to this configuration, the cylindrical-shaped stationary blade holder to which the stationary blade plate is attached supports the weight of the stationary blade plate, the wind pressure load, and the fluctuation load when an angle is changed. However, the linkage fixed together with the stationary blade holder having a hollow cylindrical shape is held by support base at the outer peripheral part thereof and strongly pivotally supported rotatably around the horizontal axis at a predetermined angle. Therefore, it is possible to maintain the horizontal axis horizontally by suppressing the sagging downward against the weight of the stationary blade plate and the wind pressure load. Furthermore, it is possible to maintain the horizontal axis direction and a rotation angle against the load fluctuation due to the rotation of the stationary blade plate and against the fluctuation of wind pressure. Therefore, it is possible to securely exhibit a function of changing the wind direction by the stationary blade plate.

Furthermore, the present invention has a configuration in which each rotation axis of the linkage is provided in the direction at the same angle from each standard line that links between a center of the fixed axis of the outer-rotation motor portion and the tip of each linkage.

With this configuration, a plurality of blade plates are radially arranged at an equal angle around the vertical central axis of the outer-rotation motor portion. However, the rotation axis of the linkage supporting the stationary blade plate is provided in the direction at the same angle $\alpha$ from each standard line X linking between the center of the fixed axis of the outer-rotation motor portion and the tip of the linkage. Therefore, regardless of the rotation positions of the blade plates, the stationary blade plates are not overlapped with the blade plates located below. Therefore, it is possible to suppress a rapid pressure fluctuation due to the interference of the stationary blade plates adjacent to the blade plates, and therefore it is possible to achieve a quiet air-blowing motion with vibration and noise reduced.

Furthermore, the present invention has a configuration in which a fitting portion to which the stationary blade holder is engageably and detachably placed is provided on the root portion of the stationary blade plate; and a movable plate portion pivotally supported that is rotatably from the horizontal direction to the elevation angle direction, and a pressing spring that biases the movable plate portion to the fitting portion side are provided in the upper part of the fitting portion of the stationary blade plate. In the configuration, an engaging protrusion provided on the back surface of the movable plate portion is biased to the outer peripheral surface of the stationary blade holder and allowed to slide, and then the engaging protrusion can be fitted into the engaging hole provided on the stationary blade holder in a state in which it is pressed.

According to this configuration, a holding fitting portion of the stationary blade holder and a fitting portion (hollow cylindrical-shape portion) on the root portion of the stationary blade plate are detachably fitted to each other. Furthermore, a movable plate portion pivotally supported rotatably only in the direction of the elevation angle is provided in the upper part of the fitting portion of the stationary blade plate. The engaging protrusion provided on the rear side of the movable plate portion is always pressed to the holding fitting portion of the stationary blade holder by the pressing spring. Therefore, when a fitting portion (hollow cylindrical-shaped portion) of the stationary blade plate is fitted into the holding fitting portion of the stationary blade holder, an engaging protrusion of the movable plate portion is allowed to advance while it is brought into close contact with and pushed up by the surface of the holding fitting portion of the stationary blade holder. Finally, the engaging protrusion is fitted into the engaging hole of the stationary blade holder and placed thereon, and a fitting force is maintained by the pressing spring. Therefore, it is possible to confirm by the feel that the stationary blade plate is securely placed on a predetermined position. Furthermore, it is possible to hold the placed stationary blade plate so that it does not drop off.

Furthermore, in the present invention, the pressing spring includes a ring-shaped tip folding portion on the tip, and this tip folding portion is disposed on the front end part of the movable plate portion. When the stationary blade plate is placed on the stationary blade holder, the tip folding portion can be engaged with the stationary blade protruding portion provided on the stationary blade holder.

With this configuration, the pressing spring is set in the movable plate portion that is rotatably set on the stationary blade plate. A rear end folding portion provided on one end of the pressing spring is engaged with a thin-plate protruding portion provided on a thin plate portion of the stationary blade plate. A tip folding portion provided on the other end of the pressing spring advances in a state in which the engaging protrusion of the movable plate portion is lifted by the holding fitting portion when the stationary blade plate is placed on the stationary blade holder. Furthermore, when the engaging protrusion is fitted into the engaging hole, a tip folding portion on the other end of the pressing spring fixed to the movable plate portion is engaged with the thin-plate protruding portion of the stationary blade holder simultaneously. Therefore, the thin plate portion of the stationary blade plate and the stationary blade protruding portion of the stationary blade holder are coupled to each other by the pressing spring. Thus, it is possible to prevent the thin plate from dropping off when the stationary blade plate is broken.

Furthermore, in the present invention, the tip position of the stationary blade plate is provided at the tip side of the blade plate and in a concentric circle in 60% to 90% of the total length of the blade plate. The cross-sectional shape of the thin-wall portion of the stationary blade plate has an arc shape that is convex downward, and the thickness dimension of the thin-wall portion is reduced in the tip side of the stationary blade plate.

According to this configuration, the blade plate of the ceiling fan exhibits good blade efficiency from the vicinity of the center to the middle to the outer periphery side of the total length of the blade. Specifically, the air blowing efficiency is good in 60% to 90% of the total length of the blade plate. In particular, the air blowing efficiency is the best in about 75%. Therefore, the total length is set so that the stationary blade plate falls in this range of the air blowing efficiency of the blade plate, and a cross-sectional shape of the thin-wall portion of the stationary blade plate has an arc shape that is convex downward and receives an air-blowing load of the blade plate. Thus, the blowing air direction can be changed efficiently while the strength is maintained so that the stationary blade plate does not bend. Furthermore, by reducing the thickness dimension of the thin-wall portion at the tip side of the stationary blade plate, it is possible to reduce the gravity load to bending.

Furthermore, the present invention has a configuration in which a ring portion provided in the pressing spring is fitted into a guide bar that is an axis of rotation of the movable plate portion; an engaging protrusion provided on the movable plate portion is detachably placed to the engaging hole provided in the stationary blade holder; as well as a tip folding portion of the pressing spring is provided in the stationary blade protruding portion capable of being engaged, and a rear end folding portion provided on the rear end of the pressing spring is engaged with a thin-plate protruding portion provided in the stationary blade holder.

According to this configuration, the guide bar provided on the movable plate portion can function as an axis of rotation of the movable plate portion and a fulcrum of the pressing spring, thus simplifying the movable plate portion and reducing the number of components. Furthermore, when the stationary blade plate is placed on the stationary blade holder, the tip folding portion of the pressing spring is fitted to the stationary blade protruding portion, and the rear end folding portion of the pressing spring is engaged with the thin-plate protruding portion. Therefore, even if the stationary blade plate is broken in a portion between the root portion and the thin plate portion of the stationary blade plate, or when the movable plate portion is broken, the stationary blade plate can be held because it is coupled to the stationary blade holder by the pressing spring and it does not drop off. Therefore, it is possible to secure the safety by preventing dropping of the stationary blade plate.

Furthermore, the present invention has a configuration in which an angle changing unit and a support base provided with the angle changing unit are detachably provided in the lower part of the stator.

According to this configuration, when an angle changing unit is added as an option in the lower part of the ceiling fan main body, the unit can be added and assembled even in a state in which the main body is set on the ceiling. Furthermore, when it is exchanged with the other option such as a light unit, large-scale setting construction is not required, and it can be carried out by a simple exchange work.

INDUSTRIAL APPLICABILITY

The present invention is suitable for a ceiling fan and the like, since an air-blowing speed and an air-blowing range can be adjusted with a small number of components and with a simple structure.

The invention claimed is:

1. A ceiling fan comprising:

an outer-rotation motor portion including a disk-like stator with a center through which a fixed axis passes, and an annular-shaped rotor pivotally supported capable of rotating around the stator;

a plurality of blade plates radially arranged on the rotor;

a support base having the fixed axis in a center of thereof and located in a lower part of the stator;

an annular-shaped angle changing unit provided on the support base; and a plurality of stationary blade plates being detachably placed on stationary blade holders provided on the angle changing unit;

wherein an elevation/depression angle of the stationary blade plates is adjustable by at least one stationary blade driving motor that drives the angle changing unit.

2. The ceiling fan of claim 1, wherein the angle changing unit comprises an eccentric cam pivotally supported by a rotation axis of the stationary blade driving motor, and an annular-shaped round cam coupled rotatably around the fixed axis by the eccentric cam, a plurality of linkages coupled to the round cam so that they move together and are pivotally supported rotatably around a horizontal axis, and stationary blade holders rotatably provided to be integrated with the linkages.

3. The ceiling fan of claim 2, wherein a protruding portion provided on an outer peripheral surface of each linkage is slidably inserted into a long hole portion provided in the round cam, and the protruding portion includes a spherical portion at a tip and a necking portion on a root of the spherical portion.

4. The ceiling fan of claim 2, wherein each linkage is formed in a lateral cylindrical shape, and a holding portion provided to be integrated with the support base is a hollow cylindrical shape rotatably holding the periphery of the linkage.

5. The ceiling fan of claim 2, wherein each rotation axis of each linkage is provided in a direction at a same angle from a standard line that links between a center of the fixed axis and each tip of the linkage.

6. The ceiling fan of claim 1, wherein a fitting portion to which the stationary blade holder is placed engageably and detachably is provided on a root portion of the stationary blade plate, a movable plate portion pivotally supported rotatably from a horizontal direction to a direction of an elevation angle and a pressing spring for biasing the movable plate portion to the fitting portion side are provided in an upper part of the fitting portion, and an engaging protrusion provided on a back surface of the movable plate portion is biased to an outer peripheral surface of the stationary blade holder and allowed to slide, and then is made to be capable of being fitted in a state in which the engaging protrusion is pressed into an engaging hole provided in the stationary blade holder.

7. The ceiling fan of claim 6, wherein the pressing spring has a ring-shaped tip folding portion on a tip, when the tip folding portion is located on the front end part of the movable plate portion and the stationary blade plate is placed on the stationary blade holder, the tip folding portion is allowed to be engaged with the stationary blade protruding portion provided on the stationary blade holder.

8. The ceiling fan of claim 6, wherein a tip position of the stationary blade plate is provided concentrically on a tip side of the blade plate and in a portion between 60% to 90% of a total length of the blade plate;

a cross sectional shape of a thin-wall portion of the stationary blade plate has an arc shape that is convex downward; and a thickness dimension of the thin-wall portion is sequentially reduced at a tip side of the stationary blade plate.

9. The ceiling fan of claim 6, wherein a ring portion provided on the pressing spring is fitted into a guide bar that is an axis of rotation of the movable plate portion, the engaging protrusion provided on the movable plate portion is detachably placed in the engaging hole provided in the stationary blade holder, a tip folding portion of the pressing spring is provided in the stationary blade protruding portion capable of being engaged, a rear end folding portion provided on a rear end of the pressing spring is engaged with a thin-plate protruding portion provided in the stationary blade plate.

10. The ceiling fan of claim 1, wherein the angle changing unit, and the support base provided with the angle changing unit are detachably provided in a lower part of the stator.

* * * * *